US007267033B1

(12) United States Patent
Lai

(10) Patent No.: US 7,267,033 B1
(45) Date of Patent: Sep. 11, 2007

(54) RATCHET WRENCH HAVING TWO DRIVING TORQUES

(76) Inventor: Chun Chou Lai, No. 68, Beisin Road, Beitun Dist., Taichung 40675 (TW)

( * ) Notice: Subject to any disclaimer, the term of this patent is extended or adjusted under 35 U.S.C. 154(b) by 0 days.

(21) Appl. No.: 11/642,100

(22) Filed: Dec. 19, 2006

(51) Int. Cl.
*B25B 17/00* (2006.01)
*B25B 13/46* (2006.01)

(52) U.S. Cl. ..... 81/57.29; 81/62

(58) Field of Classification Search ..... 81/57.29, 81/60, 58.1, 58.3, 177.85, 62, 63.1
See application file for complete search history.

(56) References Cited

U.S. PATENT DOCUMENTS 1,873,472 A * 8/1932 Pfauser ..... 81/177.85
4,939,961 A * 7/1990 Lee ..... 81/60
5,058,463 A * 10/1991 Wannop ..... 81/57.29
5,960,680 A 10/1999 Chen et al.
6,070,499 A * 6/2000 Wisbey ..... 81/57.29
6,220,123 B1 4/2001 Chen
6,311,584 B1 11/2001 Chu
6,457,386 B1 10/2002 Chiang

* cited by examiner

*Primary Examiner*—Hadi Shakeri
(74) *Attorney, Agent, or Firm*—Charles E. Baxley

(57) ABSTRACT

A ratchet wrench includes a tubular member having an inner gear formed in a head, a rotor rotatably received in the head and having a compartment aligned with the inner gear for receiving a stronger latching device, two ratchet wheels rotatably received in the head, two weaker latching devices disposed in the rotor and each having a spring-biased pawl for engaging with the ratchet wheels and for controlling the driving direction of the rotor by the ratchet wheels. A drive shaft is rotatably received in the tubular member and includes a driving gear for engaging with the ratchet wheels and for controlling the driving direction of the rotor by the ratchet wheels.

13 Claims, 7 Drawing Sheets

RATCHET WRENCH HAVING TWO DRIVING TORQUES

BACKGROUND OF THE INVENTION

1. Field of the Invention

The present invention relates to a ratchet wrench, and more particularly to a ratchet wrench including two driving assemblies or devices for allowing the ratchet wrench to drive the fasteners with different driving torques.

2. Description of the Prior Art

Typical ratchet wrenches comprise a driving gear or cartridge rotatably received in an enlarged head of a handle, and a pivotal pawl attached to the driving gear or cartridge and engageable with an internal gear of the enlarged head of the handle for controlling the driving directions of the driving gear or cartridge by the enlarged head of the handle.

For example, U.S. Pat. No. 5,960,680 to Chen et al. discloses one of the typical ratchet wrenches comprising a reversing disc coupled to the pivotal pawl for actuating the pivotal pawl to selectively engage with the internal gear of the enlarged head of the handle in order to control the driving directions of the driving gear or cartridge by the enlarged head of the handle. However, the driving gear or cartridge may only be rotated or driven by the enlarged head of the handle for a single output torque but may not be rotated or driven by the enlarged head of the handle with different output torques.

U.S. Pat. No. 6,220,123 to Chen discloses another typical ratchet wrench comprising a rotating disc coupled to the pivotal pawl for actuating the pivotal pawl to selectively engage with the internal gear of the enlarged head of the handle in order to control the driving directions of the driving gear or cartridge by the enlarged head of the handle. However, similarly, the driving gear or cartridge may only be rotated or driven by the enlarged head of the handle for a single output torque but may not be rotated or driven by the head of the handle with different output torques.

U.S. Pat. No. 6,311,584 to Chu discloses a further typical ratchet wrench comprising a driving gear or cartridge rotatably received in an enlarged head of a handle, one or more rotating discs, reverse discs, or ratchet wheels rotatably received in the enlarged head of the handle and selectively coupled to the driving gear or cartridge for selectively rotating or driving the driving gear or cartridge with one output torque, and two pivotal pawls attached to the driving gear or cartridge and engageable with an internal gear of the enlarged head of the handle for controlling the driving directions of the driving gear or cartridge by the enlarged head of the handle and for selectively rotating or driving the driving gear or cartridge with a different output torque.

However, a knob is further required to be provided and includes an extension for engaging with two pawls and two actuating rods respectively in order to control the engagement between the driving gear or cartridge and the ratchet wheels or the engagement between the driving gear or cartridge and the internal gear of the enlarged head of the handle.

U.S. Pat. No. 6,457,386 to Chiang discloses a still further typical ratchet wrench comprising a drive member and two annular gears engaged in an enlarged head of a handle, and two pairs of pivotal pawls attached to the drive member and engageable with an internal gear of the enlarged head of the handle for controlling the driving directions of the drive member by the enlarged head of the handle and for selectively rotating or driving the drive member with different output torques.

However, a complicated control member and a rotating wheel are further required to be provided for engaging with the pawls in order to control the engagement between the drive member and the ratchet wheels or the engagement between the drive member and the internal gear of the enlarged head of the handle.

The present invention has arisen to mitigate and/or obviate the afore-described disadvantages of the conventional control mechanisms for the ratchet wrenches.

SUMMARY OF THE INVENTION

The primary objective of the present invention is to provide a ratchet wrench including two driving assemblies or devices for allowing the ratchet wrench to drive the fasteners with different driving torques.

The other objective of the present invention is to provide a ratchet wrench including a simplified structure for allowing the two driving assemblies or devices of the ratchet wrench to be easily used to drive the fasteners with different driving torques without additional control member and/or the rotating wheel and/or the control knob.

In accordance with one aspect of the invention, there is provided a ratchet wrench comprising a tubular member including a head provided on one end thereof, a chamber formed in the head, and an inner gear provided in the head, the tubular member including a conduit formed therein and communicating with the chamber of the head, a rotor rotatably received in the chamber of the head and rotatably engaged in the inner gear, and including a compartment formed therein and aligned with the inner gear of the head, and including two channels formed therein, a first latching device disposed in the compartment of the rotor and including a spring-biased pawl having at least one tooth provided thereon for engaging with the inner gear of the head and for controlling a driving direction of the rotor by the head of the tubular member, two ratchet wheels rotatably received in the chamber of the head and each including a plurality of teeth formed thereon, two second latching devices disposed in the channels of the rotor respectively and each include a spring-biased pawl having at least one tooth provided thereon for engaging with the teeth of the ratchet wheels respectively and for controlling a driving direction of the rotor by the ratchet wheels respectively, and a drive shaft rotatably received in the conduit of the tubular member and including a driving gear provided on one end thereof for engaging with the teeth of the ratchet wheels respectively and for controlling the driving direction of the rotor by the ratchet wheels respectively.

The first latching device includes a seat disposed in the compartment of the rotor, and a spring member engaged between the pawl and the seat for biasing the tooth of the pawl to engage with the inner gear of the head and for allowing the rotor to be selectively rotated by the head of the tubular member either in an active driving direction or in a reverse direction. The seat of the first latching device includes no teeth formed thereon for preventing from influencing the driving operation of the rotor by the head of the tubular member.

The head includes a peripheral swelling extended into the chamber thereof for forming two inner peripheral shoulders between the head and the peripheral swelling, and the inner gear is provided on the peripheral swelling. The conduit of the tubular member is partially formed into the peripheral swelling for communicating with the chamber of the head. The ratchet wheels are engaged with the peripheral swelling of the head for being rotatably secured to the head, and the ratchet wheels are coupled to the rotor with retaining rings.

The second latching devices each include a seat disposed in the channels of the rotor respectively, and a spring member engaged between the pawl and the seat for biasing the tooth of the pawl to engage with the teeth of the ratchet wheels respectively. The seats of the second latching devices include no teeth formed thereon for preventing from influencing the driving operation of the rotor by the ratchet wheels respectively.

The drive shaft includes a peripheral recess formed therein, the tubular member includes a slot formed therein for receiving a catch therein, the catch is engaged into the peripheral recess of the drive shaft for rotatably coupling the drive shaft to the tubular member and for preventing the drive shaft from moving axially relative to the tubular member. A handle may further be provided and attached to the drive shaft for rotating the drive shaft relative to the tubular member.

The rotor includes a non-circular bore formed therein for slidably receiving a driving stem, the driving stem includes a non-circular cross section for engaging with the non-circular bore of the rotor and for allowing the driving stem to be rotated by the rotor. The rotor includes a space formed therein and communicating with the non-circular bore thereof for forming two inner peripheral shoulders in the rotor, the driving stem includes a spring-biased projection engaged in the space of the rotor and engageable with the inner peripheral shoulders of the rotor for limiting the driving stem to slide relative to the rotor and for preventing the driving stem from being disengaged from the rotor.

The driving stem includes a hole formed therein for receiving the spring-biased projection of the driving stem. The driving stem includes two end portions selectively extendible out of the rotor and each having a spring-biased projection disposed therein for engaging with the fasteners or tool members to be rotated or driven by the driving stem. The driving stem includes two cavities formed therein for receiving the spring-biased projections of the driving stem respectively.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
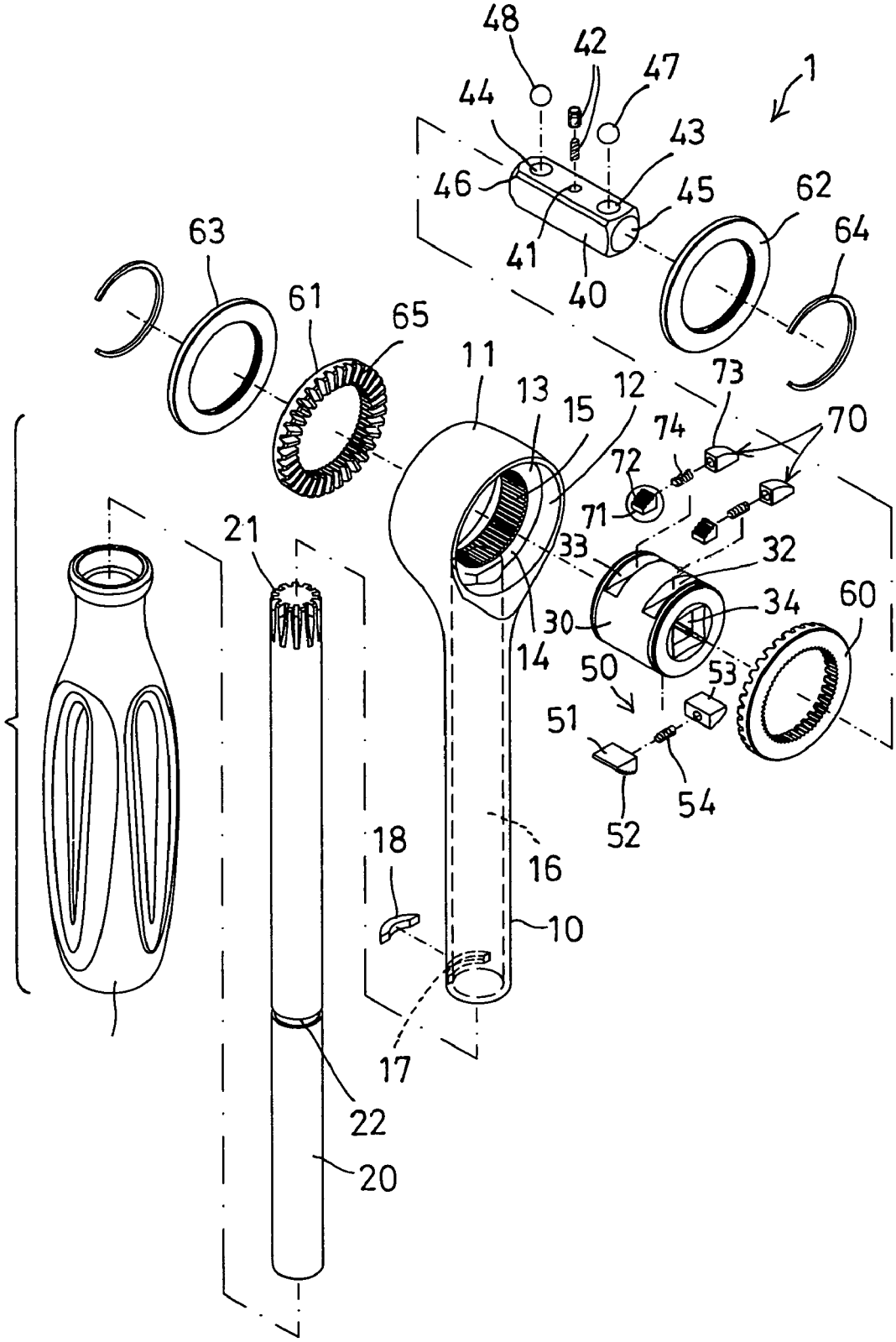
FIG. 1 is an exploded view of a ratchet wrench in accordance with the present invention.
Figure 2:
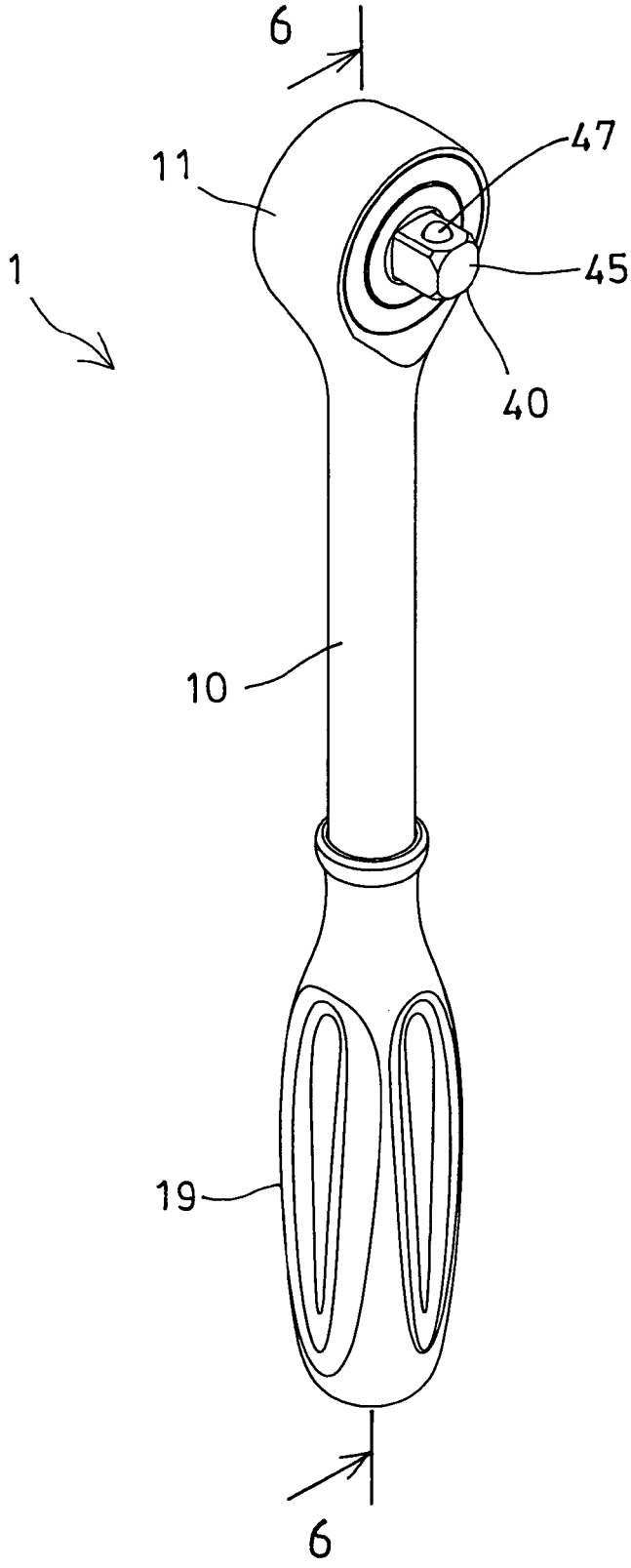
FIG. 2 is a perspective view of the ratchet wrench.
Figure 5:
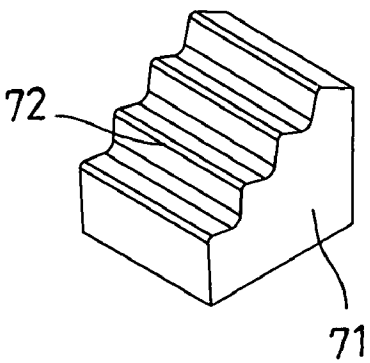
FIG. 5 is an enlarged perspective view illustrating a pawl of the ratchet wrench.
Figure 4:
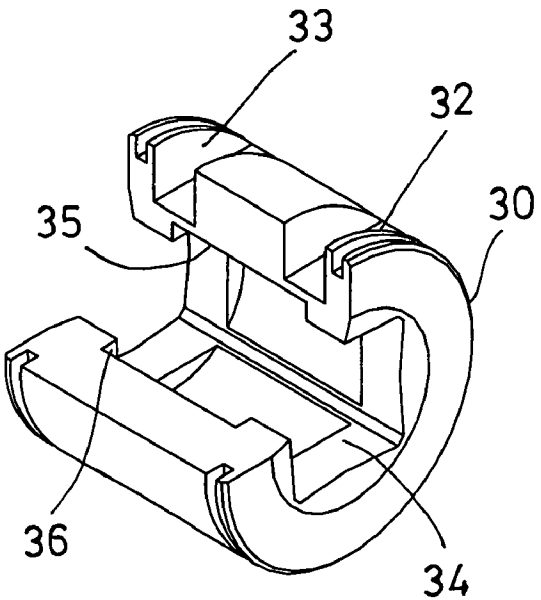
FIG. 4 is a partial perspective view illustrating an output drive member of the ratchet wrench, in which one half of the drive member has been cut off for showing an inner structure of the drive member.
Figure 3:
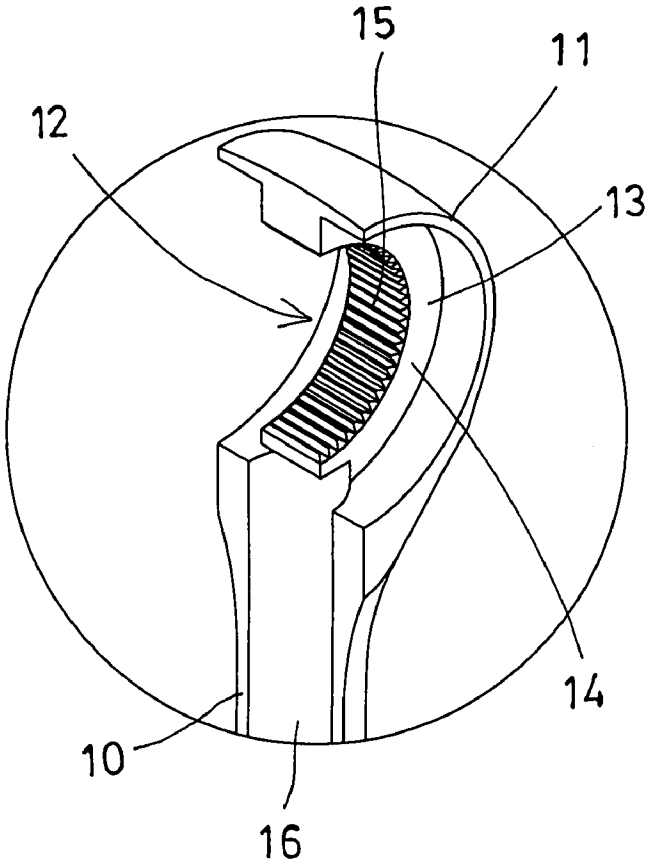
FIG. 3 is a partial perspective view illustrating an enlarged head of the ratchet wrench, in which one half of the head has been cut off for showing an inner structure of the head.

Referring to the drawings, and initially to FIGS. 1-6, a ratchet wrench 1 in accordance with the present invention comprises a longitudinal and/or tubular member 10 including an enlarged head 11 formed or provided on one end thereof, in which the head 11 includes a chamber 12 formed therein and includes a peripheral swelling 13 extended radially into the chamber 12 thereof for forming two opposite inner peripheral shoulders 14 between the head 11 and the peripheral swelling 13 and at two opposite sides of the peripheral swelling 13. The head 11 further includes an inner gear 15 formed or provided therein, such as provided on the inner peripheral portion of the peripheral swelling 13. The tubular member 10 further includes a longitudinal conduit 16 formed therein and partially formed into the peripheral swelling 13 for communicating with the chamber 12 of the head 11, best shown in FIGS. 1, 3 and 10.

Figure 7:
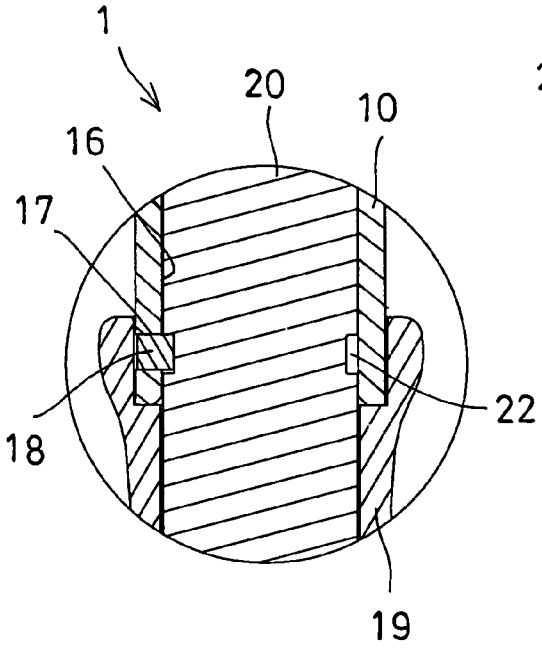
FIG. 7 is an enlarged partial cross sectional view of the ratchet wrench.

A longitudinal drive shaft 20 is rotatably received in the longitudinal conduit 16 of the tubular member 10, and includes a bevel or driving gear 21 formed or provided on one end thereof, and includes a peripheral recess 22 formed in the middle portion thereof. The tubular member 10 further includes a slot 17 formed in the other end portion thereof and located opposite to the head 11 for receiving a catch 18 therein which is engageable into the peripheral recess 22 of the drive shaft 20 (FIGS. 6, 7) for rotatably coupling the drive shaft 20 to the tubular member 10 and for allowing the drive shaft 20 to be rotated relative to the tubular member 10 only, and for preventing the drive shaft 20 from being moved longitudinally or axially relative to the tubular member 10. A handle 19 is attached to the drive shaft 20 for rotating the drive shaft 20 relative to the tubular member 10.

Figure 9:
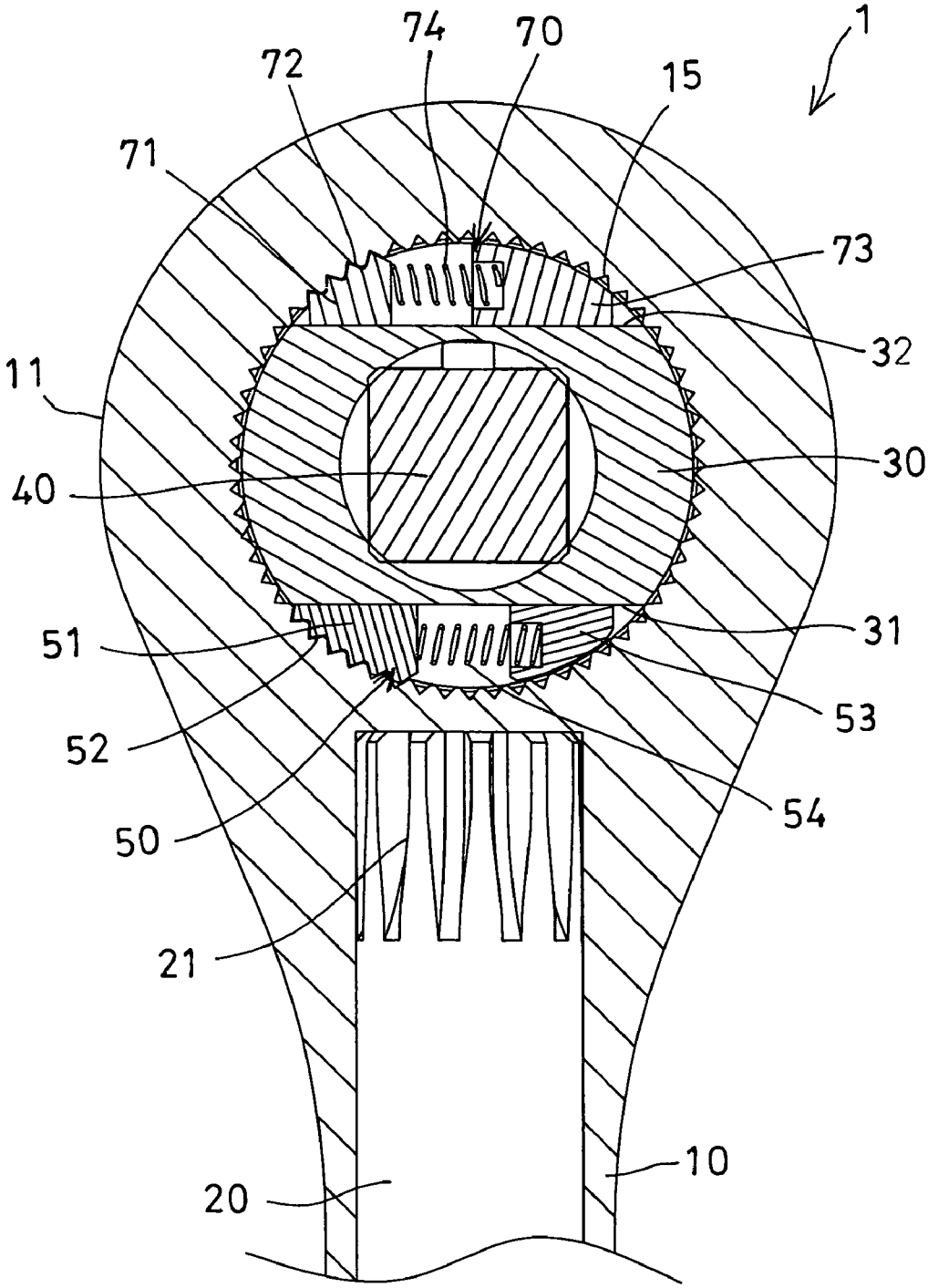
FIG. 9 is a cross sectional view of the ratchet wrench taken along lines 9-9 of FIG. 6.

A cartridge or rotor 30 is rotatably received in the chamber 12 of the head 11 and also rotatably received or engaged in the inner gear 15, and includes a compartment 31 formed in the middle and outer portion thereof and aligned with the peripheral swelling 13 and the inner gear 15 of the head 11 (FIG. 10), and further includes one or more (such as two) channels 32, 33 formed in the outer portion thereof (FIGS. 1, 4) and located opposite to the compartment 31 thereof (FIGS. 6, 9, 10), and includes a bore 34 longitudinally formed therein and having a rectangular or square or non-circular cross section for slidably receiving a driving stem 40 therein, in which the driving stem 40 includes a corresponding rectangular or square or non-circular cross section for suitably or snugly engaging with the non-circular bore 34 of the rotor 30 and for allowing the driving stem 40 to be rotated or driven by the rotor 30.

The rotor 30 further includes a circular space 35 formed in the middle portion thereof and communicating with the non-circular bore 34 thereof (FIGS. 4, 10) for forming two inner peripheral shoulders 36 in the rotor 30. The driving stem 40 includes a hole 41 formed therein (FIG. 1) for receiving a spring-biased projection 42 (FIGS. 6, 10) which may be engaged in the circular space 35 of the rotor 30 and which may be engaged with the inner peripheral shoulders 36 of the rotor 30 for limiting the driving stem 40 to slide relative to the rotor 30 and for preventing the driving stem 40 from being disengaged from the rotor 30. The driving stem 40 further includes two cavities 43, 44 formed therein and preferably formed in the two end portions 45, 46 thereof and each being provided for receiving another spring-biased projection 47, 48 (FIGS. 1, 6, 10) which may be selectively disengaged from or moved out of the rotor 30.

Figure 10:
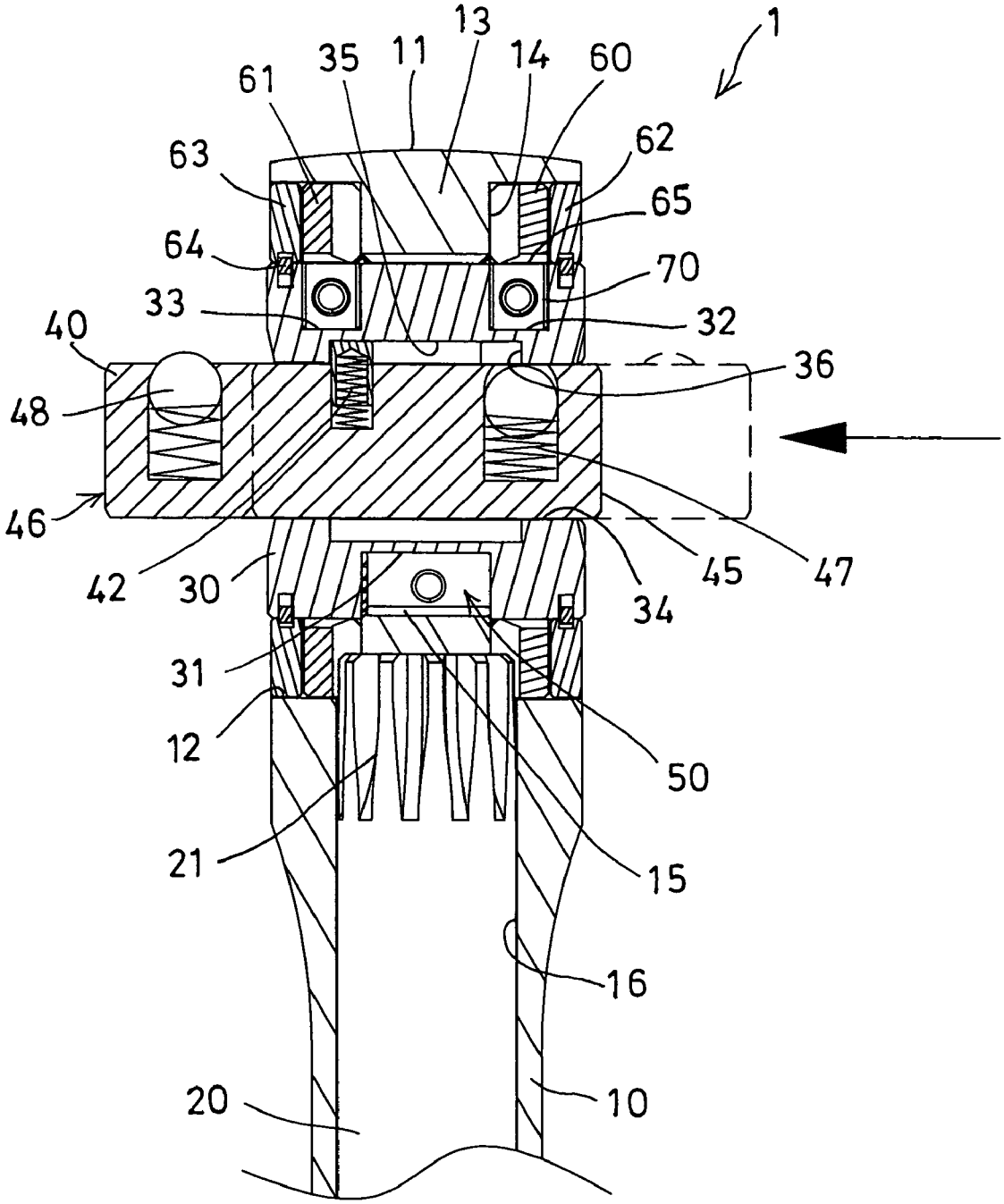
FIG. 10 is an enlarged partial cross sectional view of the ratchet wrench illustrating the operation of the ratchet wrench.

For example, as shown in FIG. 10, the driving stem 40 may be moved longitudinally along the non-circular bore 34 of the rotor 30 for allowing either of the two end portions 45, 46 of the driving stem 40 to be selectively moved out of the rotor 30 (FIGS. 2, 6, 10) in order to selectively engage with the fasteners or other tool members (not shown) to be rotated or driven by the rotor 30 and the driving stem 40, the spring-biased projections 47, 48 at the respective end portions 45, 46 of the driving stem 40 may also be selectively disengaged from or moved out of the rotor 30 and for selectively engaging with the fasteners or other tool members (not shown) to be rotated or driven by the rotor 30 and the driving stem 40 and for detachably anchoring or securing the fasteners or other tool members to the driving stem 40.

A first latching means or device 50 is disposed or engaged in the compartment 31 of the rotor 30 (FIGS. 6, 9, 10) and includes a spring-biased pawl 51 having one or more teeth 52 formed or provided thereon for engaging with the inner gear 15 of the head 11 and for controlling the driving directions of the rotor 30 by the enlarged head 11 of the tubular member 10. The first latching device 50 further includes a rounded seat 53 disposed or engaged in the compartment 31 of the rotor 30, and a spring member 54 disposed or engaged between the pawl 51 and the seat 53 for biasing the teeth 52 of the pawl 51 to engage with the inner gear 15 of the head 11 and thus for allowing the rotor 30 to be selectively rotated or driven by the enlarged head 11 of the tubular member 10 in an active or driving direction (clockwise, FIG. 9) and to be freely rotated relative to the enlarged head 11 of the tubular member 10 in a reverse direction (counterclockwise, FIG. 9).

One or more (such as two) rotating discs, reverse discs, or ratchet wheels 60, 61 are rotatably received in the chamber 12 of the head 11 and engaged with the peripheral swelling 13 of the head 11 for rotatably anchoring the ratchet wheels 60, 61 to the enlarged head 11 of the tubular member 10, and one or more (such as two) washers 62, 63 are engaged onto the ratchet wheels 60, 61 respectively and secured to the rotor 30 with such as clamping or retaining rings 64 for allowing the rotor 30 and the ratchet wheels 60, 61 to be rotatably anchored or secured to the head 11 of the tubular member 10. The ratchet wheels 60, 61 each include a number of teeth 65 formed or provided thereon and arranged circularly for forming a gear wheel 65. It is to be noted that the teeth 65 of the ratchet wheels 60, 61 are offset or disengaged or spaced from the pawl 51 and the seat 53 of the first latching device 50 (FIG. 10).

One or more (such as two) second latching means or devices 70 is disposed or engaged in the channels 32, 33 of the rotor 30 respectively (FIGS. 6, 9, 10) and each include a spring-biased pawl 71 having one or more teeth 72 formed or provided thereon for engaging with the teeth 65 of the ratchet wheels 60, 61 respectively and controlling the driving directions of the rotor 30 by the ratchet wheels 60, 61 respectively. The second latching devices 70 each further include a rounded seat 73 also disposed or engaged in the channels 32, 33 of the rotor 30 respectively, and a spring member 74 disposed or engaged between the pawl 71 and the seat 73 for biasing the teeth 72 of the pawl 71 to engage with the teeth 65 of the ratchet wheels 60, 61 respectively and thus for allowing the rotor 30 to be selectively rotated or driven in either direction by the respective ratchet wheels 60, 61.

Figure 6:
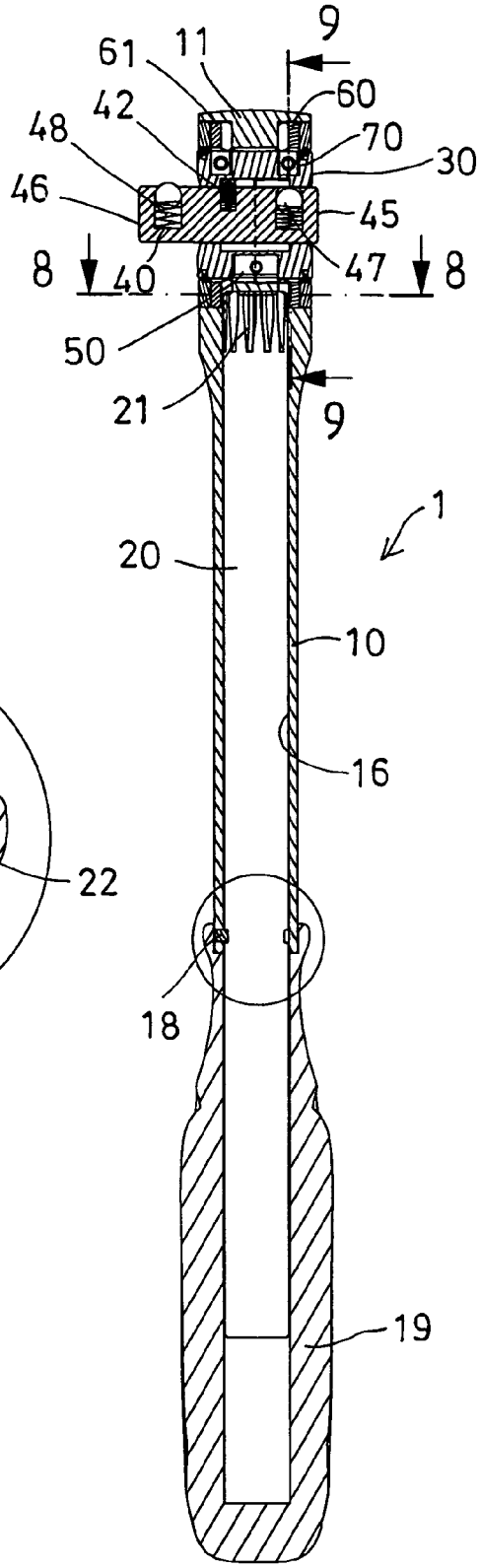
FIG. 6 is a cross sectional view of the ratchet wrench taken along lines 6-6 of FIG. 2.
Figure 8:
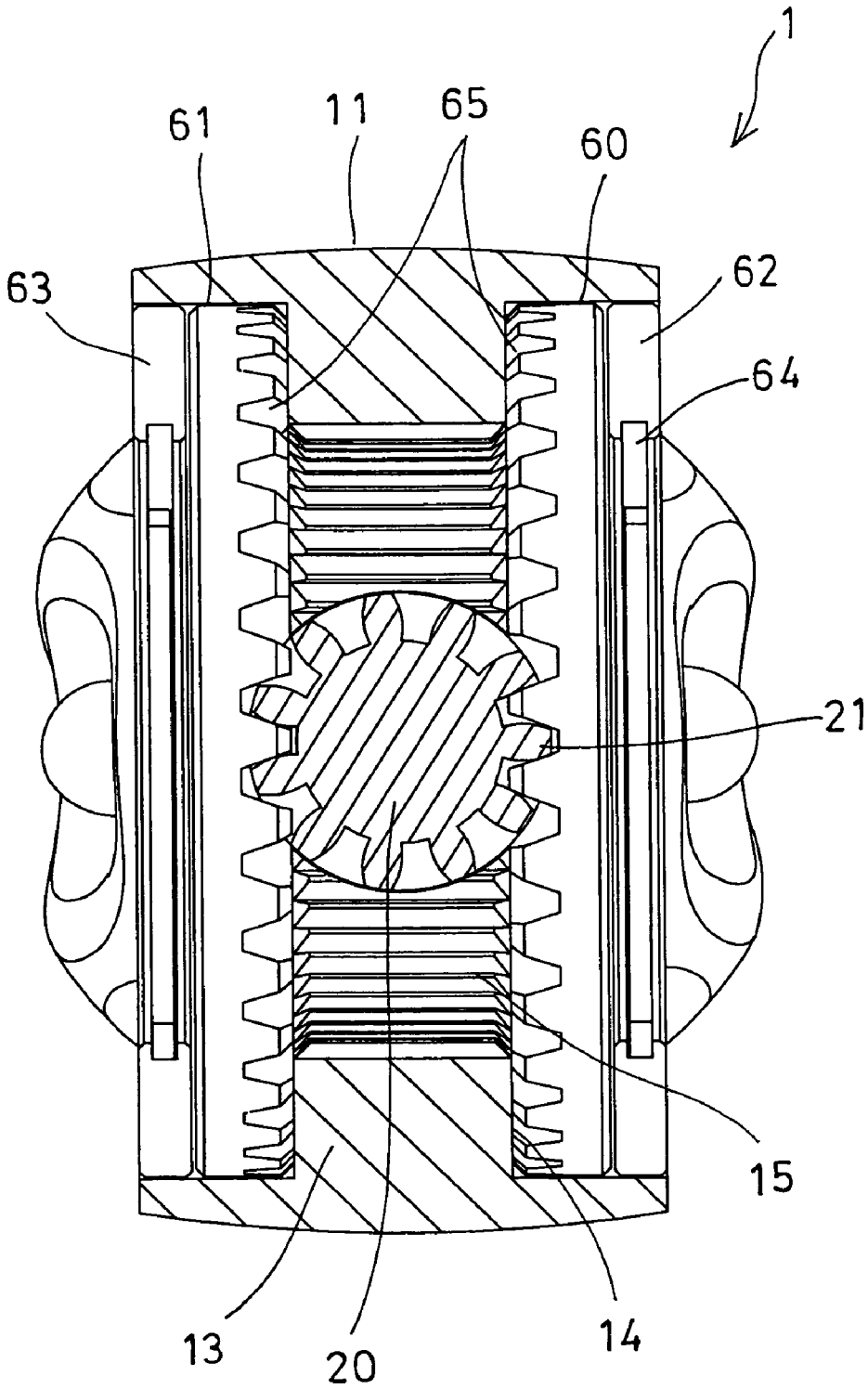
FIG. 8 is a cross sectional view of the ratchet wrench taken along lines 8-8 of FIG. 6.

As shown in FIGS. 6, 8, and 10, the driving gear 21 of the drive shaft 20 is partially engaged into the chamber 12 of the head 11 and engaged with the teeth 65 of the ratchet wheels 60, 61 respectively and thus for allowing the ratchet wheels 60, 61 to be driven or rotated relative to the enlarged head 11 of the tubular member 10 by the drive shaft 20 when the drive shaft 20 is rotated relative to the tubular member 10 with the handle 19 or by the users. When the ratchet wheels 60, 61 are driven or rotated relative to the enlarged head 11 of the tubular member 10 by the drive shaft 20, the rotor 30 may be selectively rotated or driven in either direction by the respective ratchet wheels 60, 61. It is to be noted that the engagement of the teeth 72 of the pawl 71 with the teeth 65 of the ratchet wheels 60, 61 is relatively weaker for allowing the rotor 30 and thus the driving stem 40 to be rotated or driven by the ratchet wheels 60, 61 and the drive shaft 20 with a relatively weaker or smaller driving torque.

On the contrary, the engagement of the teeth 52 of the pawl 51 of the first latching device 50 with the inner gear 15 of the head 11 is relatively stronger for allowing the rotor 30 and thus the driving stem 40 to be directly rotated or driven by the head 11 of the tubular member 10 with a relatively stronger or greater driving torque. It is further to be noted that the rounded seats 53, 73 of the latching devices 50, 70 have no teeth formed or provided thereon and will not be engaged with the inner gear 15 of the head 11 and the teeth 65 of the ratchet wheels 60, 61 and thus will not affect or influence the driving operation of the rotor 30 by the head 11 of the tubular member 10 or by the ratchet wheels 60, 61. The provision and the engagement of the teeth 52 of the pawl 51 of the first latching device 50 with the inner gear 15 of the head 11 are good enough to control the driving directions of the rotor 30 by the tubular member 10 without additional control mechanisms.

Accordingly, the ratchet wrench in accordance with the present invention includes two driving assemblies or devices for allowing the ratchet wrench to drive the fasteners with different driving torques, and includes a simplified structure for allowing the two driving assemblies or devices of the ratchet wrench to be easily used to drive the fasteners with different driving torques without additional control member and rotating wheel or the control knob.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A ratchet wrench comprising:

a tubular member including a head provided on one end thereof, a chamber formed in said head, and an inner gear provided in said head, said tubular member including a conduit formed therein and communicating with said chamber of said head, a rotor rotatably received in said chamber of said head and rotatably engaged in said inner gear, and including a compartment formed therein and aligned with said inner gear of said head, and including two channels formed therein, said rotor including a non-circular bore formed therein for slidably receiving a driving stem, said driving stem including a non-circular cross section for engaging with said non-circular bore of said rotor and for allowing said driving stem to be rotated by said rotor, said rotor including a space formed therein and communicating with said non-circular bore thereof for forming two inner peripheral shoulders in said rotor, said driving stem including a spring-biased projection engaged in said space of said rotor and engageable with said inner peripheral shoulders of said rotor for limiting said driving stem to slide relative to said rotor and for preventing said driving stem from being disengaged from said rotor, a first latching device disposed in said compartment of said rotor and including a spring-biased pawl having at least one tooth provided thereon for engaging with said inner gear of said head and for controlling a driving direction of said rotor by said head of said tubular member, two ratchet wheels rotatably received in said chamber of said head and each including a plurality of teeth formed thereon, two second latching devices disposed in said channels of said rotor respectively and each include a spring-biased pawl having at least one tooth provided thereon for engaging with said teeth of said ratchet wheels respectively and for controlling a driving direction of said rotor by said ratchet wheels respectively, and a drive shaft rotatably received in said conduit of said tubular member and including a driving gear provided on one end thereof for engaging with said teeth of said ratchet wheels respectively and for controlling the driving direction of said rotor by said ratchet wheels respectively.

2. The ratchet wrench as claimed in claim 1, wherein said first latching device includes a seat disposed in said compartment of said rotor, and a spring member engaged between said pawl and said seat for biasing said at least one tooth of said pawl to engage with said inner gear of said head and for allowing said rotor to be selectively rotated by said head of said tubular member either in an active driving direction or in a reverse direction.

3. The ratchet wrench as claimed in claim 2, wherein said seat of said first latching device includes no teeth formed thereon for preventing from influencing the driving operation of said rotor by said head of said tubular member.

4. The ratchet wrench as claimed in claim 1, wherein said head includes a peripheral swelling extended into said chamber thereof for forming two inner peripheral shoulders between said head and said peripheral swelling, and said inner gear is provided on said peripheral swelling.

5. The ratchet wrench as claimed in claim 4, wherein said conduit of said tubular member is partially formed into said peripheral swelling for communicating with said chamber of said head.

6. The ratchet wrench as claimed in claim 4, wherein said ratchet wheels are engaged with said peripheral swelling of said head and rotatably secured to said head, and said ratchet wheels are coupled to said rotor with retaining rings.

7. The ratchet wrench as claimed in claim 1, wherein said second latching devices each include a seat disposed in said channels of said rotor respectively, and a spring member engaged between said pawl and said seat for biasing said at least one tooth of said pawl to engage with said teeth of said ratchet wheels respectively.

8. The ratchet wrench as claimed in claim 7, wherein said seats of said second latching devices include no teeth formed thereon for preventing from influencing the driving operation of said rotor by said ratchet wheels respectively.

9. The ratchet wrench as claimed in claim 1, wherein said drive shaft includes a peripheral recess formed therein, said tubular member includes a slot formed therein for receiving a catch therein, said catch is engaged into said peripheral recess of said drive shaft for rotatably coupling said drive shaft to said tubular member and for preventing said drive shaft from moving axially relative to said tubular member.

10. The ratchet wrench as claimed in claim 1, wherein a handle is attached to said drive shaft for rotating said drive shaft relative to said tubular member.

11. The ratchet wrench as claimed in claim 1, wherein said driving stem includes a hole formed therein for receiving said spring-biased projection of said driving stem.

12. A ratchet wrench comprising:

a tubular member including a head provided on one end thereof, a chamber formed in said head, and an inner gear provided in said head, said tubular member including a conduit formed therein and communicating with said chamber of said head, a rotor rotatable received in said chamber of said head and rotatably engaged in said inner gear, and including a compartment formed therein and aligned with said inner gear of said head, and including two channels formed therein, said rotor including a non-circular bore formed therein for slidably receiving a driving stem, said driving stem including a non-circular cross section for engaging with said non-circular bore of said rotor and for allowing said driving stem to be rotated by said rotor, said driving stem including two end portions selectively extendible out of said rotor and each having a spring-biased projection disposed therein, a first latching device disposed in said compartment of said rotor and including a spring-biased pawl having at least one tooth provided thereon for engaging with said inner gear of said head and for controlling a driving direction of said rotor by said head of said tubular member, two ratchet wheels rotatably received in said chamber of said head and each including a plurality of teeth formed thereon, two second latching devices disposed in said channels of said rotor respectively and each include a spring-biased pawl having at least one tooth provided thereon for engaging with said teeth of said ratchet wheels respectively and for controlling a driving direction of said rotor by said ratchet wheels respectively, and a drive shaft rotatable received in said conduit of said tubular member and including a driving gear provided on one end thereof for engaging with said teeth of said ratchet wheels respectively and for controlling the driving direction of said rotor by said ratchet wheels respectively.

13. The ratchet wrench as claimed in claim 12, wherein said driving stem includes two cavities formed therein for receiving said spring-biased projections of said driving stem respectively.

* * * * *